US006571876B2

(12) United States Patent
Szarka

(10) Patent No.: US 6,571,876 B2
(45) Date of Patent: Jun. 3, 2003

(54) FILL UP TOOL AND MUD SAVER FOR TOP DRIVES

(75) Inventor: David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 49 days.

(21) Appl. No.: 09/865,089

(22) Filed: May 24, 2001

(65) Prior Publication Data

US 2002/0174988 A1 Nov. 28, 2002

(51) Int. Cl.[7] ..... E21B 34/10
(52) U.S. Cl. ..... 166/325; 175/218
(58) Field of Search ..... 166/325, 77.1, 166/77.51, 85.1, 85.3, 86.1, 88.1; 175/214, 218; 137/515, 515.3, 515.5, 515.7, 520

(56) References Cited

U.S. PATENT DOCUMENTS

| | | | | |
|---|---|---|---|---|
| 2,128,352 A | 8/1938 | Creighton | ..... | 255/28 |
| 2,155,609 A | 4/1939 | McClendon et al. | ..... | 166/1 |

(List continued on next page.)

FOREIGN PATENT DOCUMENTS

| | | | |
|---|---|---|---|
| EP | 0 543 642 A2 | 5/1993 | ..... E21B/33/126 |
| GB | 2 309 470 A | 7/1997 | ..... E21B/21/10 |
| WO | WO 98/14688 | 4/1998 | ..... E21B/33/05 |
| WO | WO 98/48143 | 10/1998 | |

OTHER PUBLICATIONS

Four Pages From A 1958 Halliburton Sales and Service Catalog.
Three Pages From A 1960 Halliburton Sales and Services Catalog.
Allamon & Associates brochure entitles "EZ–GO Surge Reduction System" (undated).
Guiberson–Ava brochure entitled Retrievable Packer Production and Completion Accessories (p. 37) (undated).
Halliburton Drill Pipe Fill Up Sub (undated).

*Primary Examiner*—David Bagnell
*Assistant Examiner*—Jennifer R. Dougherty
(74) *Attorney, Agent, or Firm*—Craig W. Roddy; Carlos A. Torres

(57) ABSTRACT

A tubular tool body carried at the end of a drilling rig top drive is received within a drill string being used as a landing string to position casing in a wellbore. External threads on the tool body can be mated with the box threads of the drill string to secure the top drive and drill string together for simultaneous drill string movement and fluid circulation. An annular seal carried about the tool body engages and seals with the internal wall of the drill pipe to prevent drilling fluid leakage when the tool body is received within the drill pipe without thread engagement. The tool has an internal check valve that opens to allow back flow of drilling fluid that may be displaced from the drill pipe as the pipe is lowered into the well. The check valve prevents standing fluid in the top drive from spilling onto the rig floor when the tool is withdrawn from the drill string. Pump pressure applied through the top drive axially moves the check valve against a biasing spring to open a bypass through the wall of the tool to permit forward circulation through the drill string and casing. The spring bias force is sufficient to withstand the hydrostatic force exerted by the standing column of fluid in the top drive and associated piping.

35 Claims, 2 Drawing Sheets

U.S. PATENT DOCUMENTS

| | | | | | |
|---|---|---|---|---|---|
| 2,602,510 | A | | 7/1952 | Baker | 166/1 |
| 2,741,314 | A | | 4/1956 | Deters | 166/295 |
| 2,791,279 | A | | 5/1957 | Clark, Jr. | 166/225 |
| 2,846,015 | A | | 8/1958 | Pittman | 166/224 |
| 2,847,074 | A | | 8/1958 | Maly et al. | 166/224 |
| 2,928,470 | A | | 3/1960 | Baker | 166/154 |
| 2,947,363 | A | | 8/1960 | Sackett et al. | 166/224 |
| 2,998,075 | A | | 8/1961 | Clark, Jr. | 166/194 |
| 3,338,311 | A | | 8/1967 | Conrad | 166/154 |
| 3,385,370 | A | | 5/1968 | Knox et al. | 166/225 |
| 3,527,297 | A | | 9/1970 | Todd | 166/154 |
| 3,554,281 | A | * | 1/1971 | Ecuer | 166/155 |
| 3,559,734 | A | | 2/1971 | Pitts | 166/224 |
| 3,633,671 | A | | 1/1972 | Nelson | 166/224 |
| 3,802,521 | A | | 4/1974 | Oliver | 175/318 |
| 3,901,333 | A | | 8/1975 | Mori | 175/242 |
| 3,957,114 | A | | 5/1976 | Streich | 166/285 |
| 4,067,358 | A | | 1/1978 | Streich | 137/624.13 |
| 4,083,409 | A | | 4/1978 | Barrington | 166/320 |
| 4,100,969 | A | | 7/1978 | Randermann, Jr. | 166/324 |
| 4,103,739 | A | | 8/1978 | Hall | 166/105 |
| 4,105,069 | A | | 8/1978 | Baker | 166/51 |
| 4,162,691 | A | | 7/1979 | Perkins | 137/613 |
| 4,248,264 | A | | 2/1981 | Hadsell et al. | 137/454.2 |
| 4,590,998 | A | | 5/1986 | Hopper | 166/331 |
| 4,662,453 | A | | 5/1987 | Brisco | 166/387 |
| 4,664,192 | A | | 5/1987 | Hogarth | 166/291 |
| 4,880,058 | A | | 11/1989 | Lindsey et al. | 166/289 |
| 5,040,606 | A | | 8/1991 | Hopper | 166/332 |
| 5,178,219 | A | | 1/1993 | Streich et al. | 166/289 |
| 5,234,052 | A | | 8/1993 | Coone et al. | 166/155 |
| 5,297,629 | A | | 3/1994 | Barrington et al. | 166/297 |
| 5,472,053 | A | | 12/1995 | Sullaway et al. | 166/327 |
| 5,540,280 | A | | 7/1996 | Schultz et al. | 166/250.07 |
| 5,597,016 | A | | 1/1997 | Manke et al. | 138/46 |
| 5,641,021 | A | | 6/1997 | Murray et al. | 166/291 |
| 5,735,348 | A | | 4/1998 | Hawkins | 166/285 |
| 5,960,881 | A | | 10/1999 | Allamon et al. | 166/291 |
| 6,082,459 | A | | 7/2000 | Rogers et al. | 166/334.1 |
| 6,182,766 | B1 | | 2/2001 | Rogers et al. | 166/386 |
| 6,386,289 | B1 | * | 5/2002 | Patel | 166/317 |
| 2002/0084069 | A1 | | 7/2002 | Mosing et al. | 166/177.4 |

* cited by examiner

FILL UP TOOL AND MUD SAVER FOR TOP DRIVES

BACKGROUND OF THE INVENTION

1. Field of the Invention

The present invention relates generally to the drilling and completion of wells drilled into the earth for the recovery of hydrocarbons. More specifically, the present invention relates to tools used to prevent spillage of well drilling fluids from the fluid circulating system of a top drive of a drilling rig while maintaining the ability to quickly reestablish forward circulation of fluids through the system when necessary.

2. Description of the Background Setting

Casing installed in subsea completions and casing installed as a liner in land and subsea completions is positioned within the well with a landing string, typically a drill string, which has a smaller internal diameter than that of the casing. The use of a landing string is necessary for liners and subsea wells because the casing strings do not extend back to the well surface. As the casing is being lowered into the well, an automatic valve at the bottom of the casing opens to permit well fluids in the wellbore to flow into and fill the casing. Unless the pipe is lowered very slowly, a reverse flow of drilling fluids is induced through the smaller diameter drill string being used to install the casing. Special measures must be taken to confine any reverse flow of drilling fluid from the drill pipe at the well surface.

Drilling rigs that are equipped with top drives can contain the back flow by making up the threaded end of the top drive into each joint or stand of drill pipe as the pipe is being run into the well. The requirement to repeatedly make up and disengage the top drive threads, however, is time consuming and therefore expensive, particularly in offshore installations.

One prior art drill pipe fill up tool for top drives permits drilling mud to back flow through the top drive and associated piping into the rig's mud pits. The fill up tool slides into the top of the drill string and seals with the drill string to contain displaced fluid as the string is being lowered. The prior art system permits rapid lowering of the drill string without danger of spilling the overflow onto the rig floor. However, while the prior art fill up tool contains the back flow of drilling fluid as the string is being lowered into the well, once the drill string is suspended from slips on the rig floor and the fill up tool is withdrawn from the top of the drill pipe string, the fluid in the top drive and associated flexible piping is freed to flow out onto the rig floor.

SUMMARY OF THE INVENTION

A tool connected to the end of the rig's top drive is provided with a check valve assembly that opens to permit drilling fluid to flow in reverse through the drill pipe as the drill string and casing string are being lowered into the wellbore. The check valve closes to prevent drainage or forward fluid flow from the top drive and associated piping to prevent fluid spillage onto the rig floor when the top drive is disconnected from the drill string. The check valve assembly may be pressure activated by initiating pumping in the circulating system to overcome a spring bias to thereby enable high-pressure flow in the forward-checked direction. The check valve thus functions to permit reverse flow as required to fill the casing, prevents spillage onto the drilling rig floor when the top drive is extracted from the drill string and permits forward fluid flow as necessary to establish circulation when the top drive is connected to the drill string.

Accordingly, it will be appreciated that a general object of the present invention is to provide a tool for preventing spillage of fluids from a drilling rig system used to position well pipe in a well.

Another object to the present invention is to provide a tool for automatically permitting either reverse flow or forward circulation flow of fluid through a well string as a function of the pressure of the fluid acting across the tool.

A specific object of the present invention is to provide a tool for use in a top drive drilling system that accommodates return flow of well fluids from a casing string being installed with a drill string and that prevents leakage of fluid from the top drive and associated piping when the top drive is separated from the drill string while selectively permitting forward pumping circulation through the top drive and drill string as the drill string and casing are being lowered into the well.

It is also an object of the present invention to provide a fill up tool that permits the safe running of subsea completion strings and casing liners from drilling rigs using a top drive unit while maintaining minimal drilling fluid loss and greatly reducing adverse environmental impact.

The foregoing objects, features and advantages of the present invention, as well as others, will be more fully understood and better appreciated by reference to the following specification and claims.

DESCRIPTION OF THE ILLUSTRATED EMBODIMENTS

Figure 1:
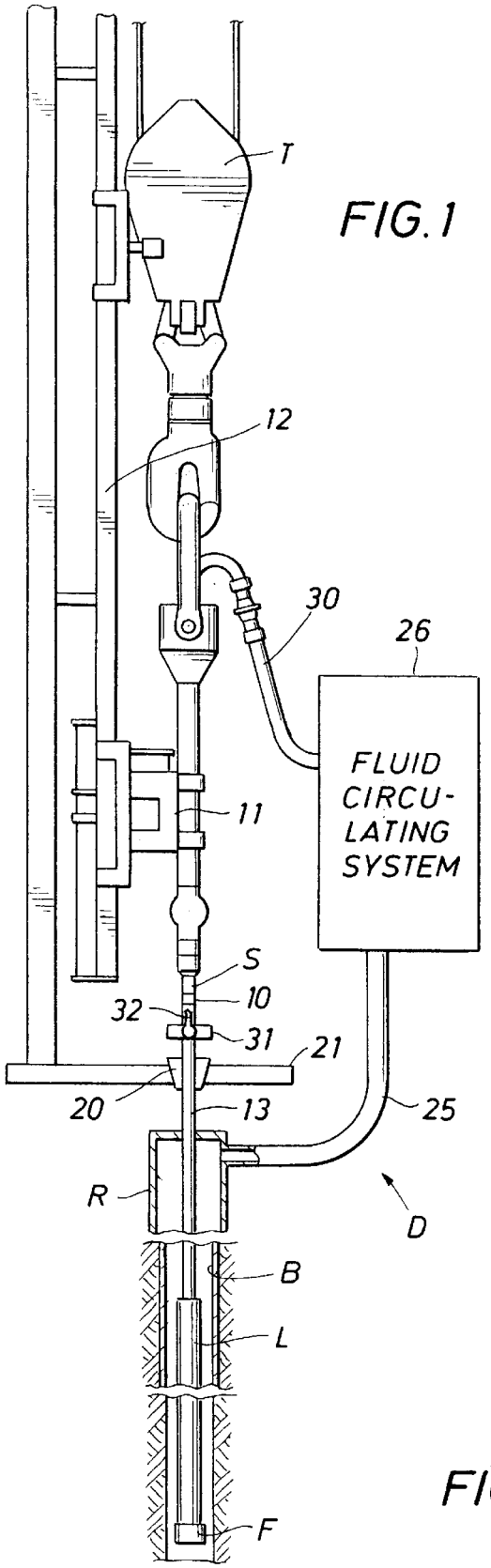
FIG. 1 is a vertical elevation, partially in section, schematically illustrating a top drive drilling system employing the tool of the present invention.

FIG. 1 illustrates a top drive fill up and mud saver tool of the present invention, indicated generally at 10, included as part of an offshore drilling system, indicated generally at D. The drilling system D is equipped with a top drive 11 supported for vertical movement along a torque track 12 in a conventional manner. The top of the tool 10 connects to the top drive through a saver sub S.

The tool 10 is illustrated connected to the top of a drill string 13, which is supported by slips 20 from a floor 21 of the drilling system D. The drill string 13 supports a casing liner L being run into a well bore B. An automatic fill up shoe F at the bottom of the liner L automatically opens to allow drilling fluids in the bore to flow into the liner. A well pipe, which may be a riser R, extends from the wellbore B to return fluid in the wellbore into a returns line 25 that connects with the system's fluid circulating system 26. The circulating system contains pumps, tanks, filtration and separation mechanisms and other well-known, conventional components. A flexible fluid hose 30 communicates fluids between the circulating system 26 and the vertically movable top drive 11. A drill pipe elevator 31 secured to elevator bales 32 extending from the top drive 11 moves the drill string 13 vertically with the top drive. The top drive 11 is raised and lowered by a traveling block T.

As illustrated in FIG. 1, the liner L is lowered into the wellbore B by lowering the top drive 11 and attached drill string 13 vertically. The downward motion of the liner L through the drilling fluid produces a ramming action that forces fluid flow upwardly through the liner and attached drill string 13. The reverse fluid flow through the drill string is contained by the connection with the top drive system 11 so that the returning fluid is forced into the fluid circulating system 26.

The liner is lowered into the wellbore B by adding drill pipe sections to the drill string 13. When the tool 10 is separated from the drill string 13 to add another length of drill pipe, well fluid contained within the tool 10, saver sub S, top drive 11 and flexible hose 30, unless checked, is free to fall or drain onto the rig floor. The tool 10 of the present invention prevents such fluid loss.

Figure 2:
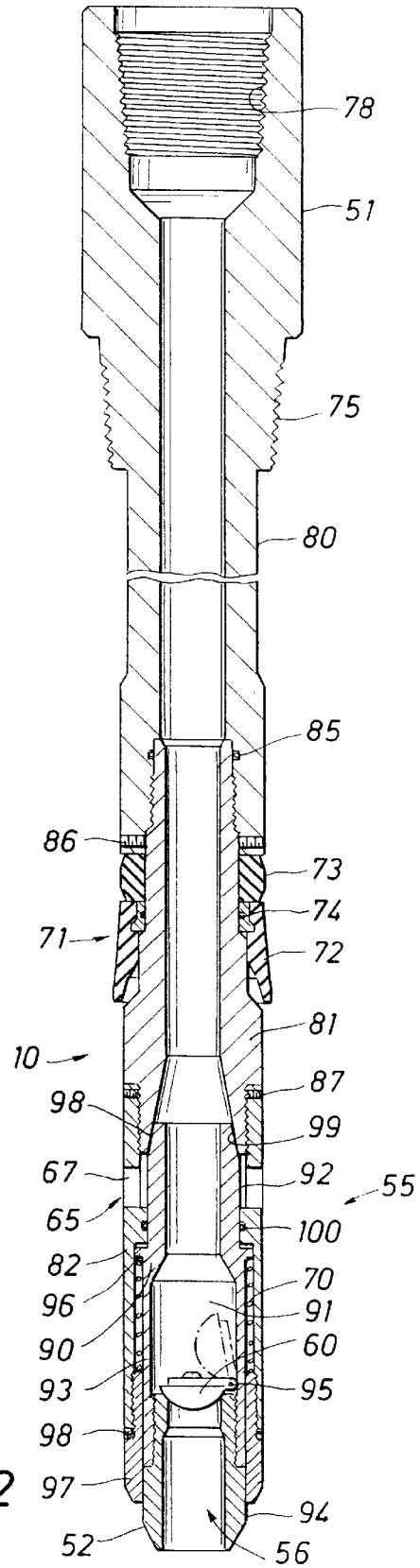
FIG. 2 is a vertical sectional view illustrating details of the tool of the present invention.

As best illustrated in FIG. 2, the tool 10 comprises an axially extending tubular tool body having an inlet end 51 and an outlet end 52. An axially movable check valve assembly, indicated generally at 55, is disposed within the tubular tool body intermediate the inlet end 51 and the outlet end 52. A flow passage 56 extends through the check valve assembly 55 for conducting fluids in the body of the tool 10 through the check valve assembly. A valve closure element, indicated by a flapper valve element 60, is movable between open and closed flow passage positions that respectively permit and prevent fluid flow through the flow passage 56. The flapper element 60 is biased by a small spring 60*a* toward the closed flow passage position.

Figure 3:
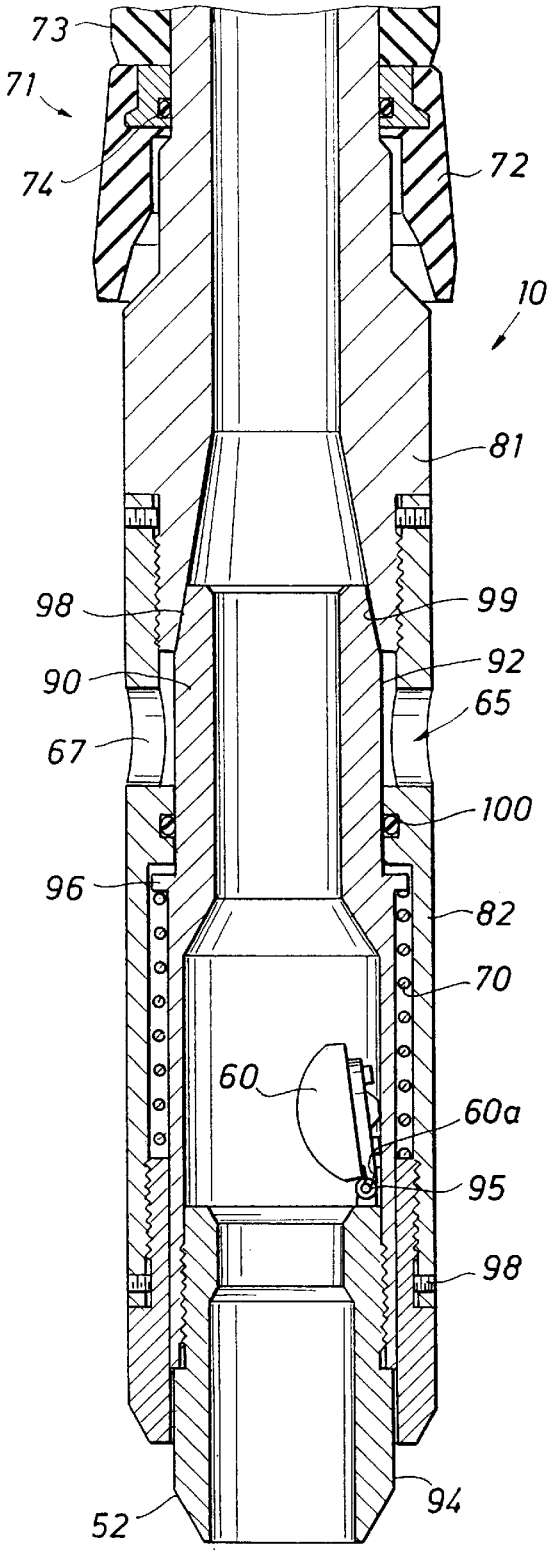
FIG. 3 is a partial vertical sectional view illustrating the tool of the present invention with the flapper of the check valve in its open position permitting reverse flow of fluids.
Figure 4:
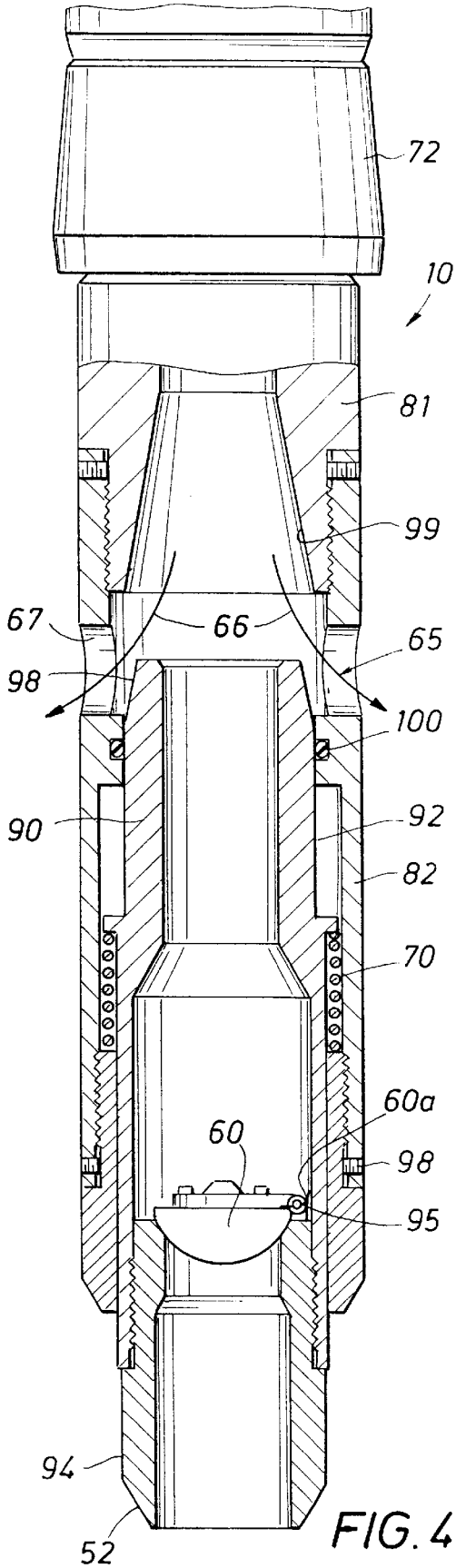
FIG. 4 is a partial vertical sectional view of the tool of the present invention with the flapper of the check valve in its closed position and with the bypass flow passage opened for forward circulation.

Referring jointly to FIGS. 3 and 4, a bypass flow passage 65 permits flow in a direction indicated by the arrows 66 in FIG. 4, from a location within the tubular body through radial ports 67 to a location external to the tubular body. Such flow is prevented when the check valve assembly 55 is in the axial position illustrated in FIG. 3 and is permitted when the check valve assembly is in the position illustrated in FIG. 4. A coil spring 70, disposed coaxially with the tool 10, biases the check valve assembly 55 into the closed position illustrated in FIG. 3. The bypass flow passage 65 is opened by pump pressure exerted against the closed check valve to permit forward circulation through the drill string and liner.

The tool 10 is provided with an annular external seal indicated generally at 71, extending radially from the external surface of the tubular body intermediate the tool inlet end 51 and the outlet end 52. The seal 71 comprises a swab cup type sealing element 72 and an annular packer type compression seal 73. The packer seal 73 is compressibly set when a sufficiently high hydraulic pressure acts against the swab cup sealing element 72. Setting the packer seal 73 reinforces the seal between the tool 10 and the surrounding wall of the drill pipe is increasing pressure of the well fluid in the drill string. An elastomeric O-ring 74 seals the swab cup to the external surface of the tool 10.

An annular external threaded area 75 is provided immediate the inlet end 51 and the outlet end 52 of the tool 10. The threaded area 75 functions as a tool joint pin to engage the tool joint box threads at the top of the drill string 13. The tool 10 is inserted into the top of the drill pipe 13 and rotated to engage the threaded pin area 75 with the box threads of the drill string. The inlet end of the tool 10 is provided with internal box threads 78 that are used to secure the tool to the pin threads extending from the saver sub S.

The tool 10 is comprised of a tubular tool joint section 80, an intermediate tubular seal carrier 81 and a tubular check valve housing 82. The seal carrier 81 is threaded to the tool joint section 80. An elastomeric O-ring seal 85 is disposed between the section 80 and the carrier 81. Lock pins 86 prevent unthreading of the carrier 81 and tool joint sections 80. Threads secure the check valve housing 82 to the lower end of the seal carrier 81. Lock pins 87 maintain the two components in threaded engagement.

The axially movable check valve assembly 55 is comprised of a central internal sleeve or mandrel 90 having an upper bypass seal section 92 and a lower valve support section 93. Threads at the bottom of the mandrel 91 secure a tubular check valve mount 94. The check valve element 60 and spring 60*a* are hinged to the valve mount 94 by a hinge pin 95. As best illustrated in FIG. 2, the valve element 60 pivots open about the pin 95 against the bias of the spring 60*a* to allow reverse flow and pivots closed under the influences of the flapper element weight, the bias of the spring 60*a* and the effect of flow of fluid to prevent forward flow through the central passage 56.

The coil spring 70 is coaxially disposed radially between the check valve housing and the mandrel or valve support section 93. The coil spring 70 is confined axially between a radial mandrel shoulder 96 and a keeper bushing 97 threaded into the base of the valve housing 82. Lock pins 98*a* prevent the threads of the keeper bushing 97 and valve housing 82 from disengaging.

As may best be appreciated by reference to FIG. 3, the mandrel 91 is urged toward a bypass closing position by the coil spring 70, which is compressed axially between the base of the keeper bushing 94 and the mandrel shoulder 96. The upper end of the mandrel 91 is provided with a frustoconical external surface 98 that engages a correspondingly shaped frustoconical interior surface 99 at the base of the seal carrier 81. When engaged, the two frustoconical seal surfaces 98 and 99 form a first seal that cooperates with an annular, elastomeric O-ring seal 100 carried within the valve housing 82 that forms a second seal to prevent flow of fluids through the radial ports 67 of the flow passage 65. The biasing force of the spring 70 is selected to be sufficiently great that it will keep the flow passage 65 closed against the hydrostatic pressure produced by the standing column of well fluids in the tool 10, saver sub S, top drive 11 and hose section 30.

In operation, when adding a joint of drill pipe to the string 13, the fill up tool at the bottom of the top drive 11 is stabbed into the top of the joint and the top drive is advanced toward the joint until the pipe elevators 31 can be latched beneath the "bottleneck" of the tool joint. In this position, the annular seal 71 of the tool 10 engages and seals against the internal surface of the newly added pipe joint. The pin of the added joint is threaded into the box of the string 13 extending from the rig floor and the added joint and the attached drill string are raised sufficiently to release the string from the slips 20.

As the drill pipe 13 and the attached liner L are lowered into a wellbore, upward flow of fluid through the drill string increases the pressure against the flapper 60 causing it to pivot against the bias force of the spring 60*a* into the open position permitting the fluid to flow in reverse through the tool 10, top drive 11, flexible line 30 and into the fluid circulating system 26. Once the added joint has been lowered to the rig floor and hung off in the slips 20, the elevators are unlatched and the top drive is raised to break the sealing connection between the drill pipe and the tool 10. Before the connection is broken, the pressure in the tool above the flapper valve is greater than that below the flapper valve, allowing the standing column of fluid above the valve to attempt to flow into the drill string, allowing the spring 60*a* to return the check valve flapper 60 to the closed position. Once the flapper valve 60 is closed, drainage of the standing column of fluid behind the valve is stopped. With the tool 10 removed from the drill string 13 and the valve flapper 60 in the closed position, the spring force of the spring 70 is greater than the opening force exerted by the hydrostatic pressure of the standing fluid column so that the mandrel 92 remains in its uppermost, closed position as illustrated in FIG. 2.

In the course of lowering the string into the well, it may become necessary to circulate fluid in a forward direction to wash through a bridge, condition the hole, circulate out a gas bubble or otherwise perform a function requiring forward circulation through the system. Forward circulation can be initiated by overcoming the spring force that maintains the mandrel 92 in its upper position in which the sealing surfaces 98 and 99 are engaged. Initiating pumping in the circulating system raises the pressure above the closed check valve flapper 60 sufficiently to overcome the force of the spring 70. Under the influence of the pumping pressure, the mandrel 92 shifts axially downwardly into an axial position that opens the bypass 65. When the mandrel is shifted into the position illustrated in FIG. 4, fluid is free to flow from the interior of the tool 10 through the radial ports 67 and into the drill pipe 13.

The increasing pressure of the fluid in the drill string acts against the swab cup seal 72 to shift the seal axially toward the annular compression seal 73. The axial movement of the seal 72 compresses the seal 73 against the base of the tool joint section 80 to exert an increasing radial sealing force against the surrounding drill pipe wall.

If it becomes necessary to rotate the drill string and liner while circulating, the slips are set to hold the string 13 and the threaded tool joint pin area 75 on the tool 10 is lowered and made up into the top box connection of the drill pipe string. When thus engaged with the drill string 13, the top drive 11 can rotate and reciprocate the drill string during foreword circulation.

While a preferred form of the invention has been described in detail herein, it may be appreciated that various modifications in the described design and construction may be made without departing from the spirit or scope of the present invention which is more fully defined in the following claims.

What is claimed is:

1. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, and a pressure independent biasing element for exerting a biasing force to urge said check valve assembly from said second location toward said first location.

2. A pressure reversible check valve as defined in claim 1, further comprising an annular external seal extending radially from an external surface of said tubular tool body intermediate said inlet end and said outlet end for sealing said external surface with an internal surface of a surrounding, axially extending tubular body.

3. A pressure reversible check valve as defined in claim 2, further comprising an annular external threaded area extending radially from an outer external surface of said tubular tool body intermediate said inlet end and said outlet end for threadedly engaging said tubular tool body with internal threads formed on an internal surface of a surrounding, axially extending tubular body.

4. A pressure reversible check valve as defined in claim 3 wherein said annular external threaded area is disposed axially intermediate said inlet end and said annular external seal and wherein an outlet for said bypass flow passage is disposed axially intermediate said outlet end and said annular external seal.

5. A pressure reversible check valve as defined in claim 4 wherein said inlet end is threaded for receiving a mating threaded end of a tubular conductor.

6. A pressure reversible check valve as defined in claim 5 wherein said inlet end is internally threaded.

7. A pressure reversible check valve as defined in claim 6 wherein said annular external threaded area is threaded for engaging an internally threaded box of a drill string.

8. A pressure reversible check valve as defined in claim 5 wherein said inlet end is threaded for receiving a mating threaded end of a tubular connector extending from a top drive of a drilling rig.

9. A pressure reversible check valve as defined in claim 5 wherein said annular external threaded area is threaded for engaging an internally threaded box of a drill string.

10. A pressure reversible check valve as defined in claim 5 wherein said annular external threaded area of said threaded body is a pin thread for connection with a box thread of a drill string.

11. A pressure reversible check valve as defined in claim 4 further comprising first and second axially spaced annular internal sleeve seals disposed on an internal surface of said tubular tool body and wherein said bypass flow passage comprises one or more radial openings through said tubular tool body intermediate said first and second sleeve seals.

12. A pressure reversible check valve as defined in claim 11 wherein said check valve assembly comprises an axially movable valve sleeve and wherein said valve closure element is carried in said valve sleeve, said valve sleeve being axially movable into and out of sealing engagement with said second annular internal sleeve seal to respectively prevent and permit fluid flow through said bypass flow passage.

13. A pressure reversible check valve as defined in claim 2 wherein said annular external seal comprises a swab cup type seal.

14. A pressure reversible check valve as defined in claim 13, wherein said annular external seal further comprises a packer type seal actuated by axial movement of said swab cup type seal for increasing a sealing pressure between said external surface and said internal surface of said surrounding tubular body.

15. A pressure reversible check valve as defined in claim 1, further comprising an annular external threaded area extending radially from an outer external surface of said tubular tool body intermediate said inlet end and said outlet end for threadedly engaging said tubular tool body with internal threads formed on an internal surface of a surrounding, axially extending tubular body.

16. A pressure reversible check valve as defined in claim 1 wherein said check valve assembly comprises an axially movable valve sleeve and wherein said valve closure element is carried in said valve sleeve.

17. A pressure reversible check valve as defined in claim 16 wherein said valve closure element comprises a flapper valve closure member pivotally mounted within said valve sleeve for pivotal movement between said opened and closed flow passage positions.

18. A pressure reversible check valve as defined in claim 16 wherein said biasing element comprises a coil spring coaxially disposed with said axially movable valve sleeve.

19. A pressure reversible check valve as defined in claim 18 wherein said coil spring is disposed radially between said axially movable valve sleeve and said tubular tool body.

20. A pressure reversible check valve as defined in claim 1 wherein the biasing force of said biasing element is greater than a reverse force attributable to a first value of hydrostatic fluid pressure of fluid in said tubular body to maintain said bypass flow passage closed to flow of fluids.

21. A pressure reversible check valve as defined in claim 1 wherein said valve closure element is moved to said open flow passage position when fluid pressure at said outlet end is greater than fluid pressure at said inlet end.

22. A pressure reversible check valve as defined in claim 21 wherein said valve closure element is moved to said closed flow passage position when fluid pressure at said inlet end is greater than fluid pressure at said outlet end.

23. A pressure reversible check valve as defined in claim 1 wherein said bypass flow passage is closed to fluid flow when fluid pressure at said outlet end is greater than fluid pressure at said inlet end.

24. A pressure reversible check valve as defined in claim 23 wherein said bypass flow passage is open to fluid flow when fluid pressure at said inlet exceeds a first value of hydrostatic fluid pressure in said tubular body.

25. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, and wherein said check value assembly comprises an axially movable valve sleeve and wherein said valve closure element is carried in said valve sleeve, and wherein said valve closure element comprises a flapper valve closure member pivotally mounted within said valve sleeve for pivotal movement between said opened and closed flow passage positions.

26. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, and wherein said check value assembly comprises an axially movable valve sleeve and wherein said value closure element is carried in said valve sleeve, wherein said biasing element comprises a coil spring coaxially disposed with said axially movable valve sleeve.

27. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, wherein said check value assembly comprises an axially movable valve sleeve and wherein said value closure element is carried in said valve sleeve, wherein said biasing element comprises a coil spring coaxially disposed with said axially movable valve sleeve, and wherein said coil spring is disposed radially between said axially movable valve sleeve and said tubular tool body.

28. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, an annular external seal extending radially from an external surface of said tubular tool body intermediate said inlet end and said outlet end for sealing said external surface with an internal surface of a surrounding, axially extending tubular body, an annular external threaded area extending radially from an outer external surface of said tubular tool body intermediate said inlet end and said outlet end for threadedly engaging said tubular tool body with internal threads formed on an internal surface of a surrounding axially extending tubular body, and wherein said annular external threaded area is disposed axially intermediate said inlet end and said annular external seal and wherein an outlet for said bypass flow passage is disposed axially intermediate said outlet end and said annular external seal, first and second axially spaced annular internal sleeve seals disposed on an internal surface of said tubular tool body and wherein said bypass flow passage comprises one or more radial openings through said tubular tool body intermediate said first and second sleeve seals, and wherein said check valve assembly comprises an axially movable valve sleeve and wherein said valve closure element is carried in said valve sleeve, said valve sleeve being axially movable into and out of sealing engagement with said second annular internal sleeve seal to respectively prevent and permit fluid flow through said bypass flow passage.

29. A pressure reversible check valve, comprising: an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, an annular external seal extending radially from an external surface of said tubular tool body intermediate said inlet end and said outlet end for sealing said external surface with an internal surface of a surrounding, axially extending tubular body, an annular external threaded area extending radially from an outer external surface of said tubular tool body intermediate said inlet end and said outlet end for threadedly engaging said tubular tool body with internal threads formed on an internal surface of a surrounding axially extending tubular body, and wherein said annular external threaded area is disposed axially intermediate said inlet end and said annular external seal and wherein an outlet for said bypass flow passage is disposed axially intermediate said outlet end and said annular external seal, and wherein said inlet end is threaded for receiving a mating threaded end of a tubular conductor, and wherein said inlet end is threaded for receiving a mating threaded end of a tubular connector extending from a top drive of a drilling rig.

30. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, an annular external seal extending radially from an external surface of said tubular tool body intermediate said inlet end and said outlet end for sealing said external surface with an internal surface of a surrounding, axially extending tubular body, an annular external threaded area extending radially from an outer external surface of said tubular tool body intermediate said inlet end and said outlet end for threadedly engaging said tubular tool body with internal threads formed on an internal surface of a surrounding axially extending tubular body, and wherein said annular external threaded area is disposed axially intermediate said inlet end and said annular external seal and wherein an outlet for said bypass flow passage is disposed axially intermediate said outlet end and said annular external seal, and wherein said inlet end is threaded for receiving a mating threaded end of a tubular conductor, and wherein said annual external threaded area is threaded for engaging an internally threaded box of a drill string.

31. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element of exerting a biasing force to urge said check valve assembly from said second location toward said first location, and an annular external seal extending radially from an external surface of said tubular tool body intermediate said inlet end and said outlet end for sealing said external surface with an internal surface of a surrounding, axially extending tubular body, and an annular external threaded area extending radially from an outer external surface of said tubular tool body intermediate said inlet end and said outlet end for threadedly engaging said tubular tool body with internal threads formed on an internal surface of a surrounding axially extending tubular body, wherein said annular external threaded area is disposed axially intermediate said inlet end and said annular external seal and wherein an outlet for said bypass flow passage is disposed axially intermediate said outlet end and said annular external seal, wherein said inlet end is threaded for receiving a mating threaded end of a tubular conductor, and wherein said inlet end is internally threaded, and wherein said annual external threaded area is threaded for engaging an internal threaded box of a drill string.

32. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element of exerting a biasing force to urge said check valve assembly from said second location toward said first location, an annular external seal extending radially from an external surface of said tubular tool body intermediate said inlet end and said outlet end for sealing said external surface with an internal surface of a surrounding, axially extending tubular body, an annular external threaded area extending radially from an outer external surface of said tubular tool body intermediate said inlet end and said outlet end for threadedly engaging said tubular tool body with internal threads formed on an internal surface of a surrounding axially extending tubular body, and wherein said annular external threaded area is disposed axially intermediate said inlet end and said annular external seal and wherein an outlet for said bypass flow passage is disposed axially intermediate said outlet end and said annular external seal, wherein said inlet end is threaded for receiving a mating threaded end of a tubular conductor, and wherein said inlet end is threaded for receiving a mating threaded end of a tubular conductor, and wherein said annular external threaded area is threaded for engaging an internally threaded box of a drill string.

33. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element of exerting a biasing force to urge said check valve assembly from said second location toward said first location, and wherein said valve closure element is moved to said open flow passage position when fluid pressure at said outlet end is greater than fluid pressure at said inlet end; and wherein said valve closure element is moved to said closed flow passage position when fluid pressure at said inlet end is greater than fluid pressure at said outlet end.

34. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, and wherein said bypass flow passage is closed to fluid flow when fluid pressure at said outlet end is greater than fluid pressure at said inlet end.

35. A pressure reversible check valve, comprising:

an axially extending tubular tool body having an inlet end and an outlet end, an axially movable check valve assembly disposed within said tubular tool body intermediate said inlet end and said outlet end, said check valve assembly being movable between first and second axially spaced locations within said tubular tool body, a flow passage extending within said check valve assembly for conducting fluids in said tubular tool body through said check valve assembly, a valve closure element in said check valve assembly movable between opened and closed flow passage positions respectively permitting fluid flow through said flow passage and preventing fluid flow through said flow passage, a bypass flow passage in said tubular body for conducting fluids from a location within said tubular body to a location external to said tubular body, said bypass flow passage being closed to fluid flow when said check valve assembly is at said first location and being opened to fluid flow when said check valve assembly is at said second location, a biasing element for exerting a biasing force to urge said check valve assembly from said second location toward said first location, and wherein said bypass flow passage is closed to fluid flow when fluid pressure at said outlet end is greater than fluid pressure at said inlet end, and wherein said bypass flow passage is open to fluid flow when fluid pressure at said inlet exceeds a first value of hydrostatic fluid pressure in said tubular body.

* * * * *